US006474543B2

(12) United States Patent
Grell

(10) Patent No.: US 6,474,543 B2
(45) Date of Patent: Nov. 5, 2002

(54) MAILBOX ASSEMBLY

(76) Inventor: Athina Grell, 335 Lakeview Dr., Burlington, KS (US) 66839

( * ) Notice: Subject to any disclaimer, the term of this patent is extended or adjusted under 35 U.S.C. 154(b) by 0 days.

(21) Appl. No.: 09/805,322

(22) Filed: Mar. 13, 2001

(65) Prior Publication Data

US 2002/0130171 A1 Sep. 19, 2002

(51) Int. Cl.[7] ..... B65D 91/00
(52) U.S. Cl. ..... 232/38; 232/39; 248/128
(58) Field of Search ..... 232/38, 39, 29, 232/33, 17, 45; 248/128, 429; D99/29, 30

(56) References Cited

U.S. PATENT DOCUMENTS

| | | | | | |
|---|---|---|---|---|---|
| 2,723,098 | A | * | 11/1955 | Moore | 248/128 |
| 3,107,848 | A | * | 10/1963 | Penta | 232/17 |
| 3,680,773 | A | * | 8/1972 | Thompson | 232/17 |
| 4,149,333 | A | | 4/1979 | Garfinkle | |
| 4,244,512 | A | | 1/1981 | Wise | |
| 4,650,113 | A | | 3/1987 | Hunt | |
| 4,813,595 | A | | 3/1989 | Johns, Jr. et al. | |
| 4,821,952 | A | * | 4/1989 | Deciutiis | 232/17 |
| 4,872,610 | A | | 10/1989 | Grabowiecki | |
| 5,056,711 | A | | 10/1991 | Bush | |
| 5,323,959 | A | | 6/1994 | Draper | |
| 5,346,125 | A | | 9/1994 | Critzer, Sr. | |
| 5,356,072 | A | * | 10/1994 | Thomas | 232/39 |
| D376,464 | S | * | 12/1996 | Cunningham et al. | D99/31 |
| D385,676 | S | | 10/1997 | Childress et al. | |
| 6,161,756 | A | * | 12/2000 | Upton | 232/39 |

* cited by examiner

*Primary Examiner*—William L. Miller
(74) *Attorney, Agent, or Firm*—Dale J. Ream

(57) ABSTRACT

A mailbox assembly includes a mailbox housing having a base plate with exterior side walls connected to an exterior roof panel and interior side walls connected to an interior roof panel. The interior roof panel and side walls are inwardly spaced from corresponding exterior structures for defining a chamber therebetween. The front end of the chamber is closed whereas a rear end thereof is open. A sealing plate may be removably positioned so as to seal the open rear end such that the chamber may be filled with a liquid or other articles. The base plate includes rails slidable along guide channels of a bracket mountable to a mailbox support post such that the housing may be slidably removed therefrom. A locking plate is dimensioned to cover the open back of the mailbox housing and to be releasably coupled to the bracket.

18 Claims, 5 Drawing Sheets

MAILBOX ASSEMBLY

BACKGROUND OF THE INVENTION

This invention relates generally to mailboxes and, more particularly, to a transparent mailbox that is removably mountable to a support post and that defines an arcuate chamber between interior and exterior roof panels and side walls for receiving decorative articles or fillers therein.

Homeowners and other residential occupants often desire to decorate their mailbox so as to make the mailbox more attractive to themselves or others to view. Various decorative mailbox constructions have been proposed in the art, such as those providing decorative overlays or those providing for sign attachments. Although assumably effective for their intended purposes, existing devices do not provide a mailbox having a watertight display chamber nor are they easily removable from a support post.

Therefore, it is desirable to have a mailbox assembly having transparent interior and exterior roof panels and side walls. Further, it is desirable to have a mailbox assembly defining a display chamber between roof panels and side walls which may be sealed and filled with a liquid or other display articles. Finally, it is desirable to have a mailbox assembly that is removably attached to a support post.

SUMMARY OF THE INVENTION

A mailbox assembly according to the present invention includes a mailbox housing having a rectangular base plate with exterior side walls extending upwardly from longitudinal side edges of the base plate. An arcuate exterior roof panel is integrally connected to the side walls. Interior side walls extend upwardly from the base plate inwardly spaced from and parallel to the exterior side walls with an interior roof panel integrally connecting upper edges of the interior side walls. Therefore, the interior and exterior roof panels and side walls define an arcuate chamber therebetween. The roof panels and side walls may be constructed of a transparent material to allow viewing of the contents within the chamber or mailbox housing as a whole. The chamber includes a closed front end and defines an open rear end so that articles may be placed within the chamber for viewing, including liquids or granular materials.

A rim extends along the interior surface of the exterior side walls and roof panel at a position spaced from rear edges of the exterior side walls and roof panel. A sealing plate is dimensioned to fit within the open rear end defined by the exterior side walls and roof panel so as to bear against the rim and rear edges of the interior side walls and roof panel. The sealing plate may be attached to the rim and to the rear edges of the interior side walls and roof panel to form a watertight cover of the open rear end of the chamber.

The mailbox assembly includes a bracket capable of being mounted to a horizontal mounting arm of a mailbox support post. The base plate of the mailbox housing includes rails adapted to be slidably coupled to the bracket such that the mailbox housing may be slidably moved therealong or removed completely therefrom. A locking plate may be slidably attached to guide rails so as to cover the open back of the mailbox housing, the locking plate having a tab configured to be snappably coupled to the bracket.

Therefore, a general object of this invention is to provide a mailbox assembly which provides a transparent housing with an arcuate display chamber.

Another object of this invention is to provide a mailbox assembly, as aforesaid, which may be slidably mounted to or removed from a mailbox support post.

Still another object of this invention is to provide a mailbox assembly, as aforesaid, having a housing which is constructed of a transparent material for viewing the contents therein.

Yet another object of this invention is to provide a mailbox assembly, as aforesaid, in which the chamber may be filled with a liquid or granular material and sealed.

A further object of this invention is to provide a mailbox assembly, as aforesaid, which may be locked to a mounting surface.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
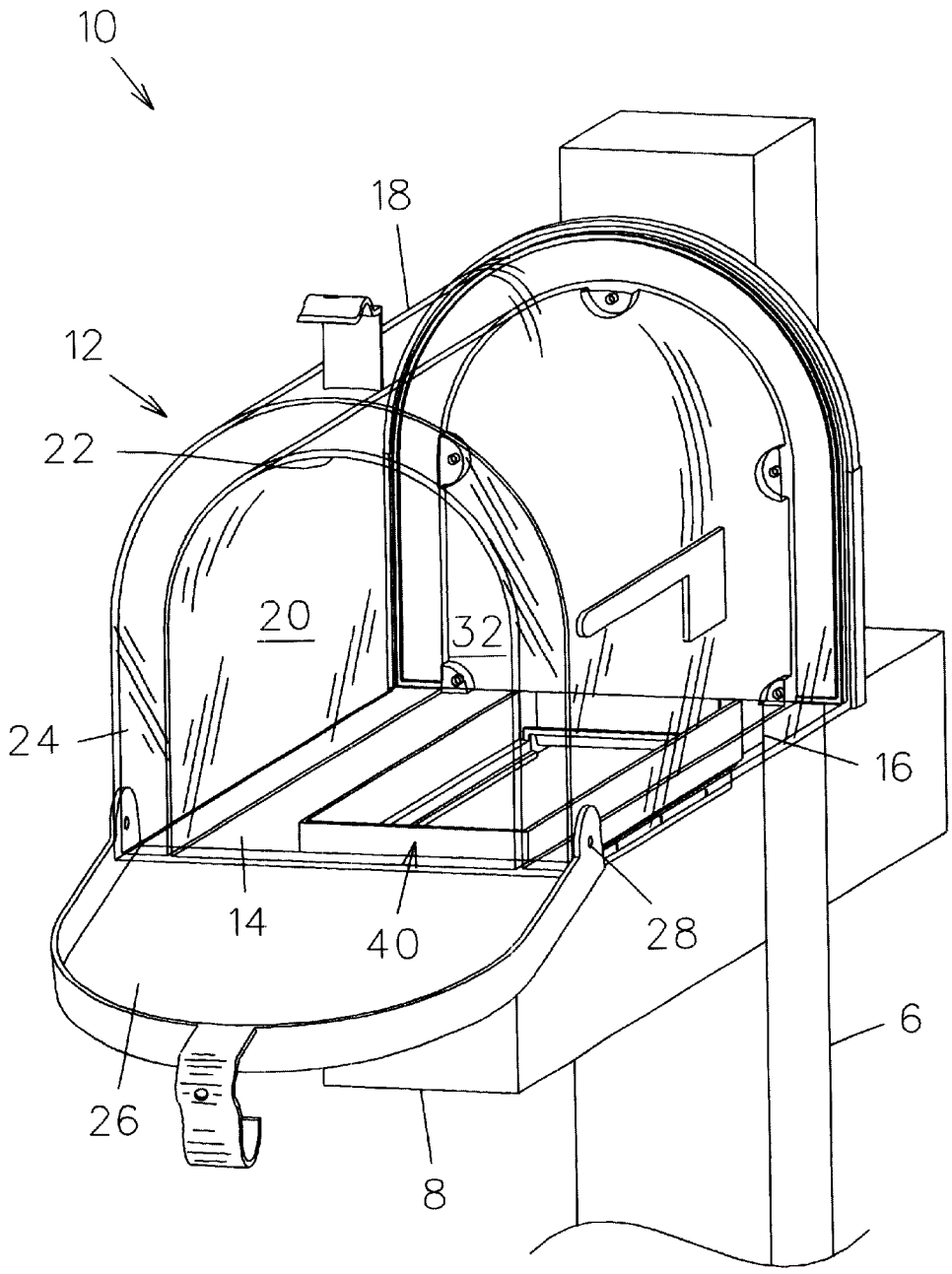
FIG. 1 is a perspective view of a mailbox assembly according to a preferred embodiment of the present invention mounted to a mailbox support post.

A mailbox assembly 10 according to a preferred embodiment of the present invention will now be described with reference to FIGS. 1–5 of the accompanying drawings. The mailbox assembly 10 includes a mailbox housing 12 having a generally rectangular base plate 14, the base plate 14 having parallel side edges extending longitudinally therealong with parallel front and rear edges extending therebetween. The mailbox housing 12 further includes a pair of planar exterior side walls 16 extending upwardly from the side edges of the base plate 14 and positioned normal to the base plate 14 (FIG. 1). An upwardly arcuate exterior roof panel 18 is integrally connected to upper edges of respective exterior side walls 16 so as to connect the side walls. The base plate 14, exterior side walls 16, and exterior roof panel 18 are constructed of a transparent material such as Plexiglas® or Lexan®.

Figure 4:
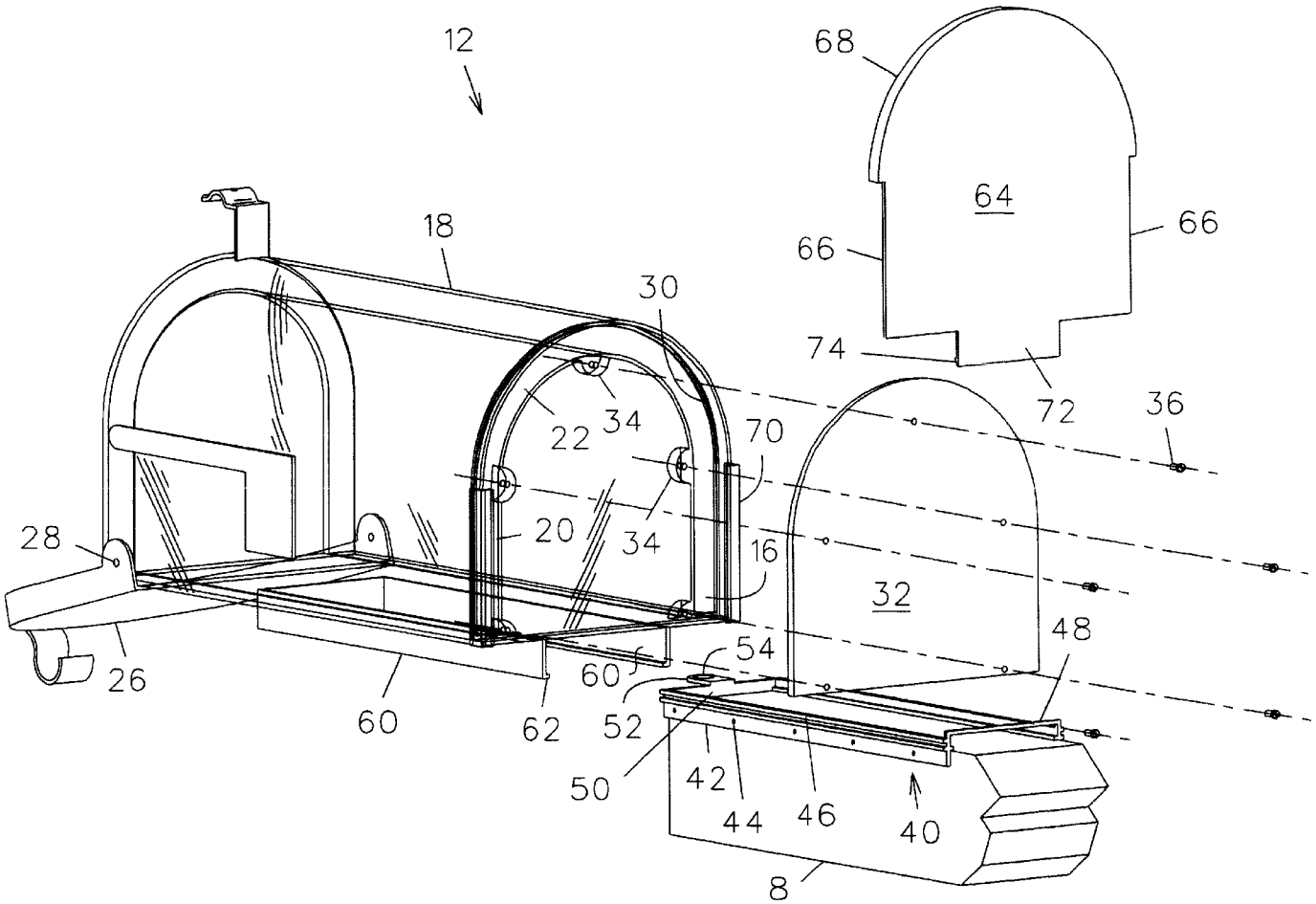
FIG. 4 is a exploded view of the mailbox assembly as in FIG. 3 with the sealing plate removed.

A pair of planar interior side walls 20 extend upwardly from the base plate 14 from a position spaced inwardly from respective exterior side walls 16 so as to define a space therebetween (FIG. 1). An upwardly arcuate interior roof panel 22 is integrally connected to upper edges of respective interior side walls 20 so as to connect the side walls. The interior roof panel is spaced inwardly from the exterior roof panel 18. Therefore, the roof panels and side walls define an arcuate chamber therebetween. The interior roof panel 22 and interior side walls 20 have a construction that is substantially similar to that of the exterior roof panel 18 and exterior side walls 16. A transparent front wall 24 extends between front edges of interior and exterior roof panels and side walls such that the front end of the chamber is closed (FIG. 1). The rear edges of interior and exterior roof panels and side walls define an open rear end (FIG. 4).

The front edges of the interior roof panel 22 and interior side walls 20 define an opening as in a conventional mailbox. A mailbox cover 26 is pivotally coupled to the exterior side walls 16 with a hinge 28 for selectively covering that opening (FIG. 1). The cover 26 is dimensioned to cover the entire front of the mailbox housing 12 when positioned in a closed configuration. The interior roof panel 22 and interior side walls 20 have length dimensions less than length dimensions of corresponding exterior roof panel 18 and exterior side walls 16. More particularly, the rear edges of the interior roof panel 22 and interior side walls 20 are frontwardly displaced from the rear edges of the exterior roof panel 18 and exterior side walls 16 (FIG. 4). The rear edges of both the exterior and interior structures define open rear ends.

Figure 3:
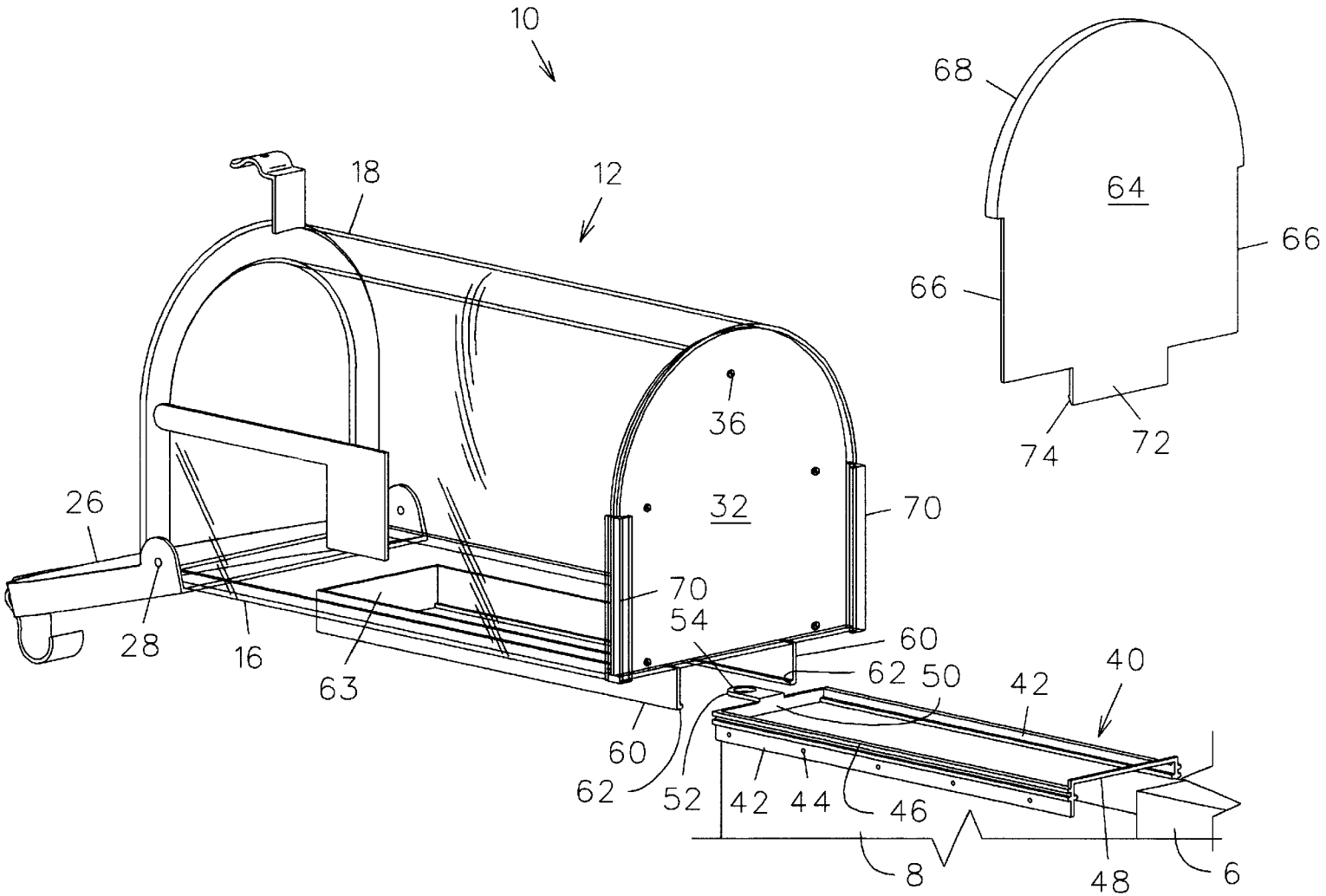
FIG. 3 is a rear perspective view of the mailbox assembly as in FIG. 1 with the mailbox housing removed from the mounting bracket and with the locking plate removed from the housing.

The mailbox housing 12 further includes a rim 30 extending along an interior surface of the exterior side walls 16 and roof panel 18 at a position displaced from rear edges thereof and parallel to rear edges of the interior side walls 20 and roof panel 22. A sealing plate 32 is dimensioned for selective placement within the open rear end defined by the exterior roof panel 18 and exterior side walls 16. When placed therein, the sealing plate 32 bears against the rim 30 and rear edges of the interior side walls 20 and interior roof panel 22 so as to cover the open rear end of the chamber. A plurality of flanges 34 are spaced apart along rear edges of the interior side walls 20 and interior roof panel 22 to which the sealing plate may be removably attached with fasteners such as screws 36 (FIGS. 3 and 4). The rim 30 and sealing plate 32 may include gaskets and the like for maintaining a watertight seal.

Figure 5:
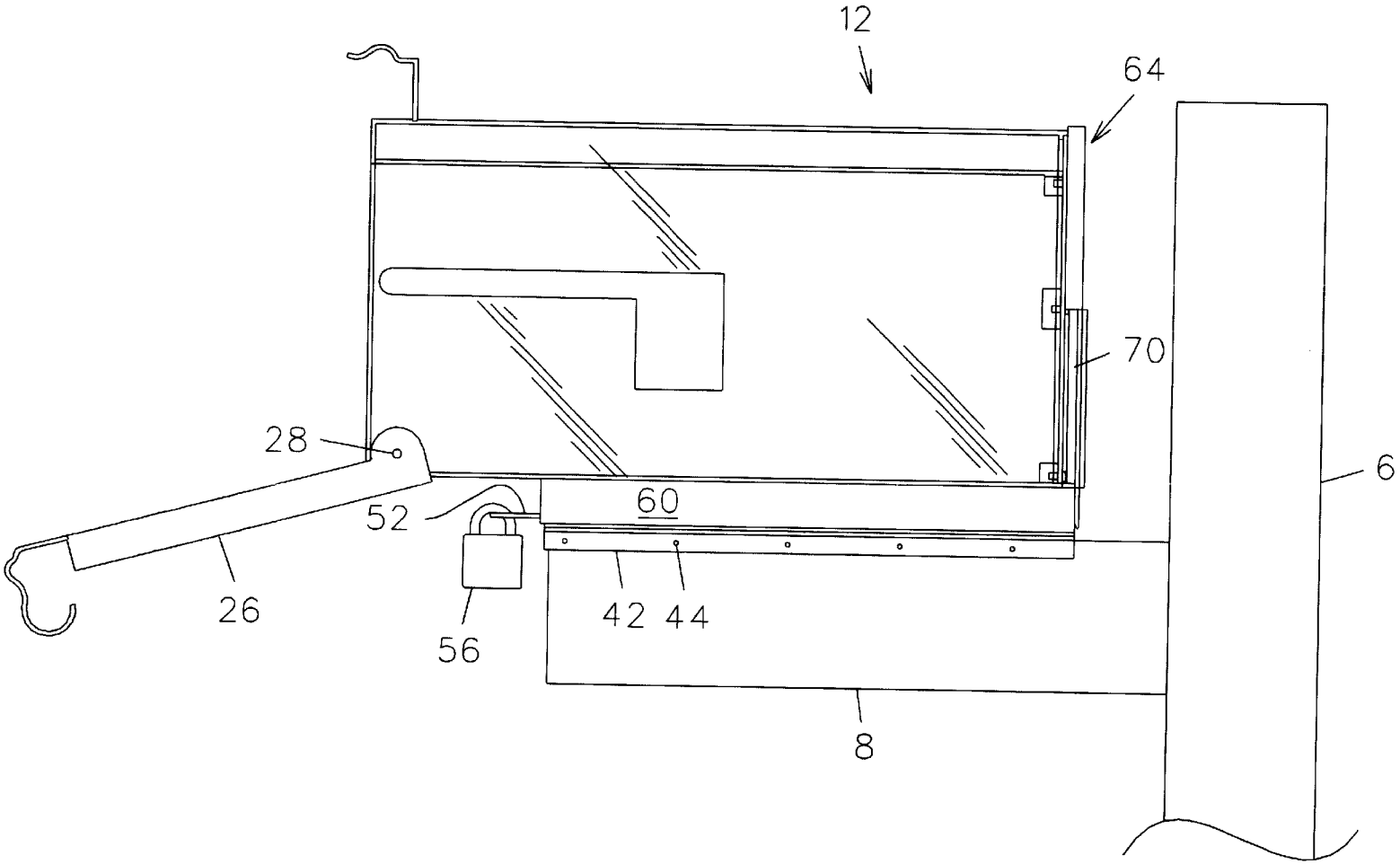
FIG. 5 is a side view of the mailbox assembly as in FIG. 1.

The mailbox assembly 10 includes a bracket 40 having a pair of parallel side arms 42 defining a plurality of apertures 44 therealong by which the bracket 40 may be removably coupled to a horizontal mounting arm 8 of a mailbox support post 6 (FIGS. 1 and 3). Each side arm 42 further defines a longitudinally extending guide channel 46 having open ends. A bar 48 extends between rear ends of the side arms 42 and is vertically offset a short distance from the rear ends with support legs. A support arm 50 extends between front ends of the bracket side arms 42, the support arm 50 having a flange 52 normal thereto and extending forwardly therefrom (FIG. 3). The flange 52 defines an opening 54 capable of receiving a padlock 56 therethrough, as to be described more fully below (FIG. 5). A pair of parallel rails 60 extend longitudinally along a bottom surface of the base plate 14 of the mailbox housing 12. Each rail 60 includes a nub 62 extending longitudinally along a free edge thereof configured to mate with a respective guide channel 46 for slidable movement therealong. Therefore, the mailbox housing 12 may be slidably coupled to the bracket 40 or removed completely therefrom. A support wall 63 extends between front ends of the rails 60.

Figure 2:
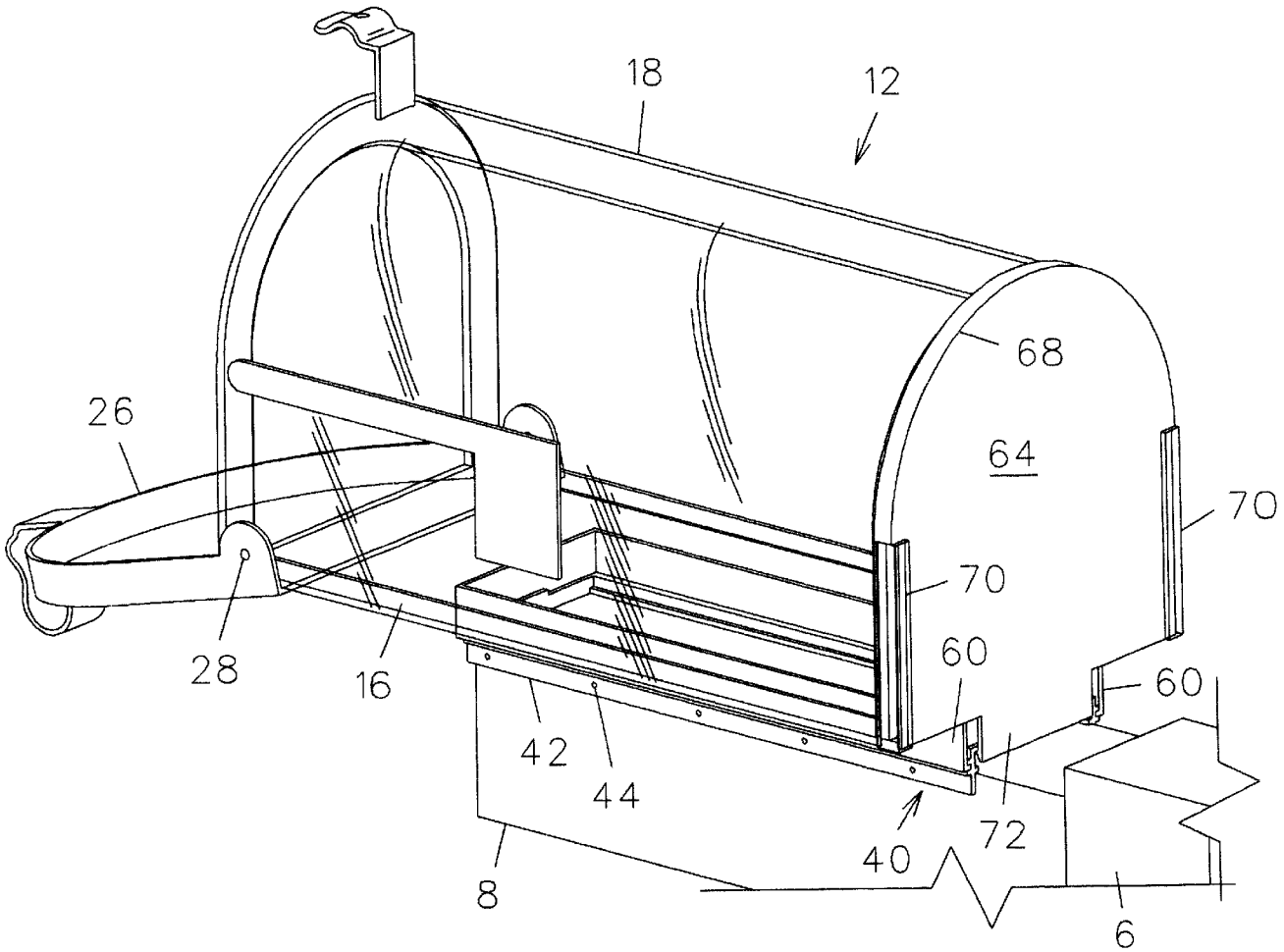
FIG. 2 is a rear perspective view of the mailbox assembly as in FIG. 1.

The mailbox assembly 10 further includes a locking plate 64 having parallel side edges 66 connected to an arcuate top edge 68 and being dimensioned to completely cover the open rear end formed by the exterior side walls 16 and exterior roof panel 18 (FIG. 3). A pair of guide members 70 extend upwardly from the base plate 14 at the rear edge thereof and are configured to slidably receive respective side edges 66 therein (FIG. 2). The locking plate 64 includes a tab 72 depending from a bottom edge thereof. The tab 72 includes a nub 74 extending along a bottom edge thereof, the nub being configured to snappably engage the bar 48 of the bracket 40 when the rails 60 of the mailbox housing 12 are positioned completely rearwardly along the bracket guide channels 46 and the locking plate 64 is slidably received in the guide members 70 (FIG. 2).

In use, the mounting bracket 40 may be attached to the mounting arm 8 of a mailbox support post 6 with screws or the like. Then, the mailbox housing 12 may be coupled to the bracket 40 by aligning the rails 60 with respective guide channels 46 (FIG. 3) and slidably moving the housing rearwardly therealong. When the mailbox housing 12 is completely rearwardly positioned upon the bracket 40, the locking plate 64 may be slidably inserted along the guide members 70 such that the nub 74 of the tab 72 engages the bracket bar 48 so as to preclude undesired forward movement (FIG. 2). In this configuration, a padlock 56 may be coupled to the bracket flange 52. This precludes forward movement and thus removal of the mailbox housing 12 in that the padlock 56 blocks movement of the support wall 63 across the flange 52. A reversal of these steps allows the mailbox housing 12 to be removed from the bracket 40, for instance where a user desires to transport the housing to another location to decorate it.

By slidably removing the locking plate 64 and removing the sealing plate 32 by removing the corresponding screws 36, a user may gain access to the chamber. The chamber may be filled with decorative articles such as signs, banners, illustrations, and the like. The chamber may also be filled with colored water and floating decorations or granular materials like sand. The sealing plate 32 may again be attached to the rim 30 and rear edges of the interior side walls 20 and interior roof panel 22 to seal the decorative material in the chamber.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A mailbox assembly, comprising:

a generally rectangular base plate having parallel side edges extending longitudinally therealong and parallel front and rear edges;

a transparent arcuate exterior roof panel;

a pair of transparent exterior side walls extending upwardly from said side edges of said base plate and having upper edges integrally connected to said exterior roof panel;

an arcuate interior roof panel inwardly displaced from said exterior roof panel;

a pair of interior side walls extending upwardly from said base plate and having upper edges integrally connected to said interior roof panel, said interior side walls being positioned a distance inwardly from said side edges of said base plate so as to define an arcuate chamber extending between said interior and exterior roof panels and said interior and exterior side walls adapted to receive decorative articles therein for viewing;

wherein said chamber defines an open rear end and said interior roof panel and said interior side walls include respective rear edges spaced frontwardly from rear edges of said exterior roof panel and exterior side walls, respectively;

a transparent front wall integrally connecting respective front edges of said interior and exterior roof panels and said interior and exterior side walls such that a front end of said arcuate chamber is closed;

an arcuate rim extending along an interior surface of said exterior side walls and said exterior roof panel parallel to said respective rear edges of said interior roof panel and said interior side walls;

a scaling plate dimensioned to selectively bear against said rim and said respective rear edges of said interior roof panel and said interior side walls so as to selectively cover said open rear end of said chamber; and means for selectively fastening said sealing plate to said respective rear edges of said interior roof panel and said interior side walls so as to form a watertight seal over said open rear end.

2. The mailbox assembly as in claim 1 wherein said base plate, said interior roof panel, and said interior side walls define an interior space, said interior roof panel and interior side walls being constructed of a transparent material capable of allowing viewing of contents in said interior space.

3. The mailbox assembly as in claim 1 wherein said base plate, said interior side walls and said interior roof panel define an open front, said mailbox assembly further comprising a hinged door pivotally coupled to said exterior side walls for selectively covering said open front, said door being dimensioned to cover front edges of said exterior side walls and said exterior roof panel when said open front is covered.

4. The mailbox assembly as in claim 1 further comprising:

a bracket having a pair of parallel side arms adapted to be coupled to a post support member, each side arm defining an outwardly disposed guide channel;

a pair of parallel rails depending from a bottom surface of said base plate and extending longitudinally therealong, each rail having a nub extending longitudinally along a free edge thereof adapted to mate with a respective guide channel for slidable movement therealong; and a support wall depending from a bottom side of said base plate and extending transversely between front ends of said rails.

5. The mailbox assembly as in claim 4, further comprising:

a bar extending between rear ends of said side arms of said bracket;

a support arm extending between front ends of said side arms of said bracket; and a flange extending from said support arm and defining an opening for receiving a padlock therethrough, said support arm and said flange being configured to preclude slidable movement of said rails along said guide channels when said rails are positioned completely rearwardly in said guide channels and said padlock is coupled to said flange.

6. The mailbox assembly as in claim 5 wherein said exterior side walls and said exterior roof panel define an open back, said mailbox assembly further comprising:

a pair of guide members extending upwardly from said base plate along rear edges of respective exterior side walls; and a locking plate having side edges configured to mate with respective guide members, said locking plate being dimensioned to selectively cover said open back, said locking plate including a tab depending from a lower edge thereof having a nub adapted to snappably engage said bar of said bracket when said locking plate side edges are positioned along said guide members and said rails are positioned completely rearwardly in said guide channels.

7. The mailbox assembly as in claim 1 wherein said interior roof panel, said interior side walls, said exterior roof panel, and said exterior side walls are constructed of a transparent material.

8. A mailbox assembly capable of removable attachment to a mounting arm of a mailbox support post, comprising:

a mailbox housing having a generally rectangular base plate with exterior side walls extending upwardly therefrom and an arcuate exterior roof panel integrally connected to upper edges of said exterior side walls, said mailbox housing defining an open front and an open back;

a hinged door pivotally coupled to said exterior side walls for selectively covering said open front;

a first plate dimensioned to cover said open back;

means for slidably coupling said first plate to said mailbox housing for selectively covering said open back;

a bracket having a pair of parallel side arms adapted to be attached to said mounting arm of said mailbox support post, each side arm defining an outwardly disposed guide channel having open ends;

a pair of parallel rails depending from a bottom side of said base plate and extending longitudinally therealong, each rail having a nub extending longitudinally along a free edge thereof adapted to mate with a respective guide channel for slidable movement therealong, whereby said mailbox housing may be slidably moved along said channels and selectively removed completely therefrom;

wherein said mailbox housing comprises:

an arcuate interior roof panel inwardly spaced from said exterior roof panel;

a pair of interior side walls extending upwardly from said base plate and having upper edges integrally connected to said interior roof panel, said interior side walls being positioned a distance inwardly from said exterior side walls so as to define an arcuate chamber between said interior side walls and interior roof panel and said exterior side walls and exterior roof panel said chamber adapted to receive articles therein for viewing.

9. The mailbox assembly as in claim 8 wherein said exterior roof panel and said exterior side walls are constructed of a transparent material for allowing viewing of articles in said chamber.

10. The mailbox assembly as in claim 8 wherein said exterior root panel, said exterior side walls, said interior roof panel, and said interior side walls are constructed of a transparent material.

11. The mailbox assembly as in claim 8 wherein said exterior roof panel and said exterior side walls are constructed of a transparent material.

12. The mailbox assembly as in claim 8 further comprising a support wall depending from said bottom side of said base plate and extending transversely between front ends of said rails;

wherein said bracket includes:

a bar extending between rear ends of said side arms;

a support arm extending between front ends of said side arms; and a flange extending from said support arm and defining an opening for receiving a padlock therethrough, said support arm and said flange being configured to preclude slidable movement of said rails relative to said bracket when said rails are positioned completely rearwardly along said guide channels and said padlock is coupled to said flange.

13. The mailbox assembly as in claim 12 wherein:

said coupling means includes a pair of vertical guide members extending upwardly from said base plate along rear edges of respective exterior side walls; and said first plate having side edges configured to slidably mate with respective guide members, said first plate including a tab depending from a lower edge thereof having a nub adapted to snappably engage said bar of said bracket when said first plate side edges are positioned along said guide members and said rails are positioned completely rearwardly in said guide channels.

14. The mailbox assembly as in claim 8 wherein said chamber includes a closed front end and defines an open rear end, said interior roof panel and said interior side walls including respective rear edges spaced forwardly from rear edges of said exterior roof panel and said exterior side walls, respectively, said mailbox assembly comprising;

an arcuate rim extending along an interior surface of said exterior side walls and said exterior roof panel parallel to said respective rear edges of said interior roof panel and said interior side walls;

a sealing plate dimensioned to selectively bear against said rim and said respective rear edges of said interior roof panel and said interior side walls so as to selectively cover said open rear end of said chamber; and means for selectively fastening said sealing plate to said respective rear edges of said interior roof panel and said interior side walls so as to form a watertight seal over said open rear end.

15. A mailbox assembly, comprising:

a generally rectangular base plate having parallel side edges extending longitudinally therealong and parallel front and rear edges;

a transparent arcuate exterior roof panel;

a pair of transparent exterior side walls extending upwardly from said side edges of said base plate and having upper edges integrally connected to said exterior roof panel;

an arcuate interior roof panel inwardly displaced from said exterior roof panel;

a pair of interior side walls extending upwardly from said base plate and having upper edges integrally connected to said interior roof panel, said interior side walls being positioned a distance inwardly from said side edges of said base plate so as to define an arcuate chamber extending between said interior and exterior roof panels and said interior and exterior side walls, said chamber adapted to receive decorative articles therein for viewing;

wherein said chamber includes a closed front end and defines an open rear end;

wherein said interior roof panel and said interior side walls include respective rear edges that are spaced forwardly a distance from rear edges of said exterior roof panel and said exterior side walls, respectively;

a continuous rim extending along an interior surface of said exterior side walls, said rim being spaced from said respective rear edges thereof and parallel to said respective rear edges of said interior roof panel and said interior side walls;

a sealing plate dimensioned to selectively bear against said rim and said respective rear edges of said interior roof panel and said interior side walls so as to selectively cover said open rear end of said chamber;

means for selectively sealing said sealing plate to said rim and to respective rear edges of said interior side walls such that said chamber may be filled with a liquid.

16. The mailbox assembly as in claim 15 wherein said exterior roof panel, said exterior side walls, said interior roof panel, and said interior side walls are constructed of a transparent material.

17. The mailbox assembly as in claim 15 further comprising:

a bracket having a pair of parallel side arms adapted to be coupled to a post support member, each side arm defining an outwardly disposed guide channel;

a pair of parallel rails depending from a bottom surface of said base plate and extending longitudinally therealong, each rail having a nub extending longitudinally along a free edge thereof adapted to mate with a respective guide channel for slidable movement therealong.

18. The mailbox assembly as in claim 15 wherein said base plate, said interior side walls and said interior roof panel define an open front, said mailbox assembly further comprising a hinged door pivotally coupled to said exterior side walls for selectively covering said open front, said door being dimensioned to cover front edges of said exterior side walls and said exterior roof panel when said open front is covered.

* * * * *